US005690012A

United States Patent [19]

Blandin et al.

[11] Patent Number: 5,690,012

[45] Date of Patent: Nov. 25, 1997

[54] CUTTING MODULE FOR WEB PRODUCTS AND CUTTING DEVICE EQUIPPED WITH AT LEAST ONE SUCH MODULE

[75] Inventors: Christophe Louis Michel Blandin; Pascal Philibert Bossu, both of Chalon-Sur-Saone, France

[73] Assignee: Eastman Kodak Company, Rochester, N.Y.

[21] Appl. No.: 620,519

[22] Filed: Mar. 22, 1996

[30] Foreign Application Priority Data

Apr. 10, 1995 [FR] France ..... 95 04490

[51] Int. Cl.[6] ..... B26D 1/20

[52] U.S. Cl. ..... 83/507; 83/508; 83/508.2

[58] Field of Search ..... 83/503, 507, 505, 83/508, 508.2, 508.3, 425.2, 481, 482, 502, 698.51, 698.61, 504, 498, 508.1, 563

[56] References Cited

U.S. PATENT DOCUMENTS

| | | | |
|---|---|---|---|
| 679,566 | 7/1901 | Kling | 83/105 |
| 1,996,127 | 4/1935 | Stacey | 83/505 |
| 2,187,211 | 1/1940 | McKinley | 83/482 |
| 3,039,345 | 6/1962 | Euth | 83/498 |
| 3,055,249 | 9/1962 | Lord | 83/501 |
| 3,364,803 | 1/1968 | Senftleben | 83/503 |
| 3,730,043 | 5/1973 | Zimmermann | 83/502 |
| 3,831,480 | 8/1974 | Phillips | 83/481 |
| 3,911,774 | 10/1975 | Jennings et al. | 83/425.2 |
| 4,116,098 | 9/1978 | Suzuki et al. | 83/500 |
| 4,380,945 | 4/1983 | Guild et al. | 83/482 |
| 4,428,265 | 1/1984 | Bolton | 83/402 |
| 4,627,214 | 12/1986 | Anderson et al. | 83/71 |
| 4,922,778 | 5/1990 | Nagai | 83/508.2 |
| 4,962,684 | 10/1990 | Mowry | 83/332 |
| 5,025,693 | 6/1991 | Tidland et al. | 83/504 |
| 5,211,094 | 5/1993 | Johnson | 83/507 |

FOREIGN PATENT DOCUMENTS

| | | |
|---|---|---|
| 0559966 | 12/1992 | European Pat. Off. . |
| 9400261 | 1/1991 | WIPO . |

*Primary Examiner*—Maurina T. Rachuba
*Attorney, Agent, or Firm*—Arthur H. Rosenstein

[57] ABSTRACT

A cutting module comprises a circular knife and a circular bedknife rotatively mounted on a frame in such a way that their respective axes are substantially parallel to each other. The distance between the axis of the knife and the bedknife is such that their respective periphery is brought close together or brought to bear on each other over a part of their periphery in order to cut a web passing between the knife and bedknife. The knife or the bedknife are mounted on a mechanism provided with an adjustable eccentric so as to adjust the penetration by modifying the height of engagement of the knife with respect to the bedknife.

10 Claims, 5 Drawing Sheets

CUTTING MODULE FOR WEB PRODUCTS AND CUTTING DEVICE EQUIPPED WITH AT LEAST ONE SUCH MODULE

FIELD OF THE INVENTION

The invention concerns a cutting module and a device for the longitudinal cutting of web products such as photographic strips.

BACKGROUND OF THE INVENTION

Typically, web products are cut by means of devices comprising principally a cutting shaft on which there are rotatably mounted one or more circular knives (or upper knives) provided at their center with a central bore. The knives (flat or with a land) are designed to be brought near to, or even made to bear against, corresponding bedknives (or lower knives), also mounted on a shaft substantially parallel to the first. The product is cut by means of a shearing effect to which the web is subjected during its passage between the knives and the bedknives, which overlap over a part of their periphery. Typically, the height of the overlap between the knife and the bedknife (commonly referred to as the "penetration") is around 0.1 mm to 2 mm. This, representing the degree of shearing, is a critical parameter: there is a risk that the web will not be cut over its whole thickness if the penetration is too small; conversely, the edge of the web in contact with the knife risks being damaged, for example by abrasion, if the penetration is too great.

The axial position of the knife in relation to the bedknife (referred to in the remainder of the patent by the term "bearing") constitutes another important parameter for cutting by shearing. For some applications, the knives and bedknives are mounted so as to be in dose contact (typically a spacing which can be between a few microns and a few millimeters). For other applications, the knives bear on the bedknives. For these applications, the beating force must be sufficient for the knife to always be in contact with the corresponding bedknife so as to provide the cutting geometry, but must not be too high, or else the knives and bedknives will be worn too quickly.

The bearing or axial position of the knife with respect to the bedknife is generally adjusted by means of screw threads associated with spring mechanisms.

Thus the patent U.S. Pat. No. 3,730,043 describes a device having a cutting shaft on which the knives are mounted by means of spring devices provided on the back of each knife, so as to maintain individually the bearing force needed for each knife on the corresponding bedknife. The principal drawback of such an approach lies in its complexity and cost. Similarly, it is often difficult to adjust the beating force of each of the knives very precisely and consistently.

The patent U.S. Pat. No. 4,428,265 describes a device for making a set of flat knives bear against corresponding bedknives, comprising a combination of a screw-thread system disposed at one end of the knife-carrying shaft and an appropriate tool, such as a dynamometric screwdriver, enabling the threaded system to be driven so as to adjust the bearing force of the knives on the bedknives. A spring device enables the bearing force of the knives on the bedknives to be maintained. One of the problems encountered in implementing such a solution is related to the matching of the knives to the bedknives, in particular when a high number of such knives are used, placed side by side with a spacing which must be as regular as possible in order for the bearing force resulting from the movement of the knife-carrying shaft to be the same for each knife/bedknife pair. This is because positioning errors of a few microns for each pair will be translated, at the end of the shaft, into an error which can reach several tens of millimeters.

More recently still, in order to bring the knives to bear against the bedknives, it has been proposed to use flexible knives made to bear by an axial movement of one of the cutting shafts with respect to the other. Though it helps in partially resolving the problems discussed above, this solution still does not resolve them satisfactorily, notably for certain applications.

As for the penetration, this is generally adjusted by means of shims disposed at each end of one or other of the shafts, on bearings supporting the said shafts. Thus by using shims having different thicknesses, the distance between the shaft carrying the knives and the shaft carrying the bedknives is changed discretely. The major weakness of such a solution lies principally in the discrete character of this adjustment, the quality and precision of which prove clearly insufficient for some applications.

Modules also exist which carry, on a frame, a knife and a bedknife positioned so as to be made to bear on each other over a part of their periphery so as to cut a web passing between them. Each of the knives and bedknives is associated with a motor enabling them to be rotated. Generally, no provision is made for the adjustment of the penetration and of the beating force.

SUMMARY OF THE INVENTION

FIG. 1, to which reference is now made, illustrates diagrammatically an approach such as that described in the patent U.S. Pat. No. 3,055,249, for adjustment of penetration. The device in fact comprises a mechanism for adjusting the distance between two shafts 2, 5 carrying respectively bedknives 1 and knives 3, and therefore adjusting the height of the overlap between the respective periphery of the knife 3 and bedknife 1 accordingly. To this end, a plate 12 having integral edge portions 13 is used. Each of these edge portions 13 cooperates with a guide formed in each pair of guide members 15, so that the plate 12 can slide along guides 14. The guide members are fixed to a rear plate 16 by means of nuts 17. The shaft 5 carrying the knife 3 is mounted by bearings on a plate 18 fixed to the sliding plate 12, while the shaft 2 carrying the bedknife 1 is mounted by means of bearings fixed to the rear plate 16. The lower part of the plate 12 is attached to a differential screwing mechanism. The latter comprises a nut 19 screwed onto the plate 12 by means of the screws 20, another nut 21 mounted on the rear plate by means of the screws 22, and a screw 23 provided with a head 24 by means of which the screw 23 can be actuated. The screw 23 has two threaded portions 25 and 26, with different pitches. A micrometric measurement means 27 is mounted in contact with the bottom edge of the plate 12, enabling the movement of the plate 12 to be measured with precision. The movement of the plate 12 enables the shaft 5 and knife 3 to move in a direction that is dependent on the direction of rotation of the screw 23, and thus modifies the overlap between the knife 3 and bedknife 1. This solution has the drawback of not being able to be easily implemented industrially, owing to its complexity and to the cost that this would entail.

Thus one of the objects of the present invention is to provide a cutting device for web products, free of the problems referred to above with reference to the known cutting devices.

Another object of the present invention is to provide a cutting module having simple, compact and economical means for adjusting both the penetration and the bearing of the knives.

Other objects of the present invention will appear in a detailed manner in the description that follows.

These objects are achieved according to the present invention by means of a cutting module for the cutting by shearing of web products, comprising a circular knife and bedknife, mounted so as to rotate freely on a frame in such a way that their respective axes are substantially parallel and so as to be brought very close together or brought to bear on each other over part of their periphery in order to cut a web passing between the knife and bedknife, the knife and/or the bedknife being mounted on a mechanism with an adjustable eccentric so as to adjust the penetration by modifying the height of engagement of the knife with respect to the bedknife.

Advantageously: a) the knife is mounted fixedly on a knife carrier rotatably mounted on an intermediate member; b) the intermediate member is fixed to a ring with an eccentric, means being provided for modifying the position of the intermediate member with respect to the ring with an eccentric along the axis of the knife so as to modify the bearing of the knife on the bedknife; and c) said ring with an eccentric is fixed to the frame, means being provided for modifying the angular position of the ring with an eccentric so as to modify the penetration.

Also advantageously: a) the means for adjusting the bearing of the knife on the bedknife include means for temporarily mobilizing the knife and bedknife with respect to the intermediate member; b) the module includes a first locking/unlocking means for, in a first position, adjusting the bearing, and, in a second position, maintaining fixedly the adjustment thus made; c) the intermediate member is screwed onto the ring with an eccentric so that, when said first locking/unlocking means is in the first position, the screwing of the intermediate member onto the ring is modified by mining the assembly consisting of the knife, the knife carrier and the intermediate member, thereby changing the axial position of the knife.

The module also comprises a second locking/unlocking means for, in a first position, disconnecting the ring with an eccentric from the frame and enabling the angular position of the ring to be adjusted by turning the assembly consisting of the knife, the knife carrier and the intermediate member, thereby driving the eccentric ring so as to cause it to turn through a given angle, and, in a second position, maintaining the adjustment thus made while fixing the ring to the frame.

According to the present invention, a cutting device is also produced which is equipped with at least one cutting module according to the present invention.

BRIEF DESCRIPTION OF THE DRAWINGS

In the description that preceded and follows, reference will be made to the drawings in which.

DETAILED DESCRIPTION OF THE PREFERRED EMBODIMENTS

Figure 2:
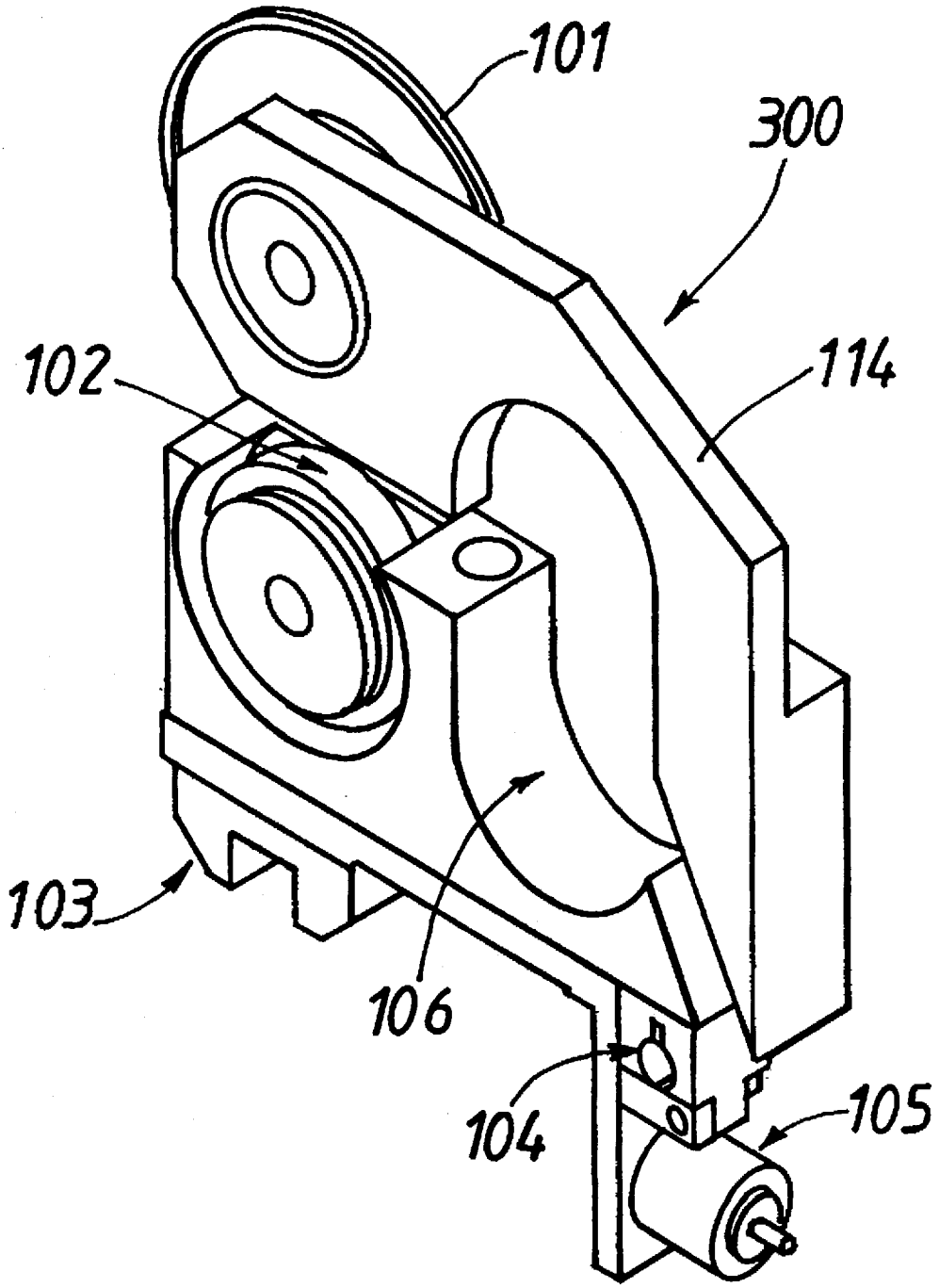
FIG. 2 depicts diagrammatically an advantageous embodiment of the cutting module according to the present invention.
Figure 5:
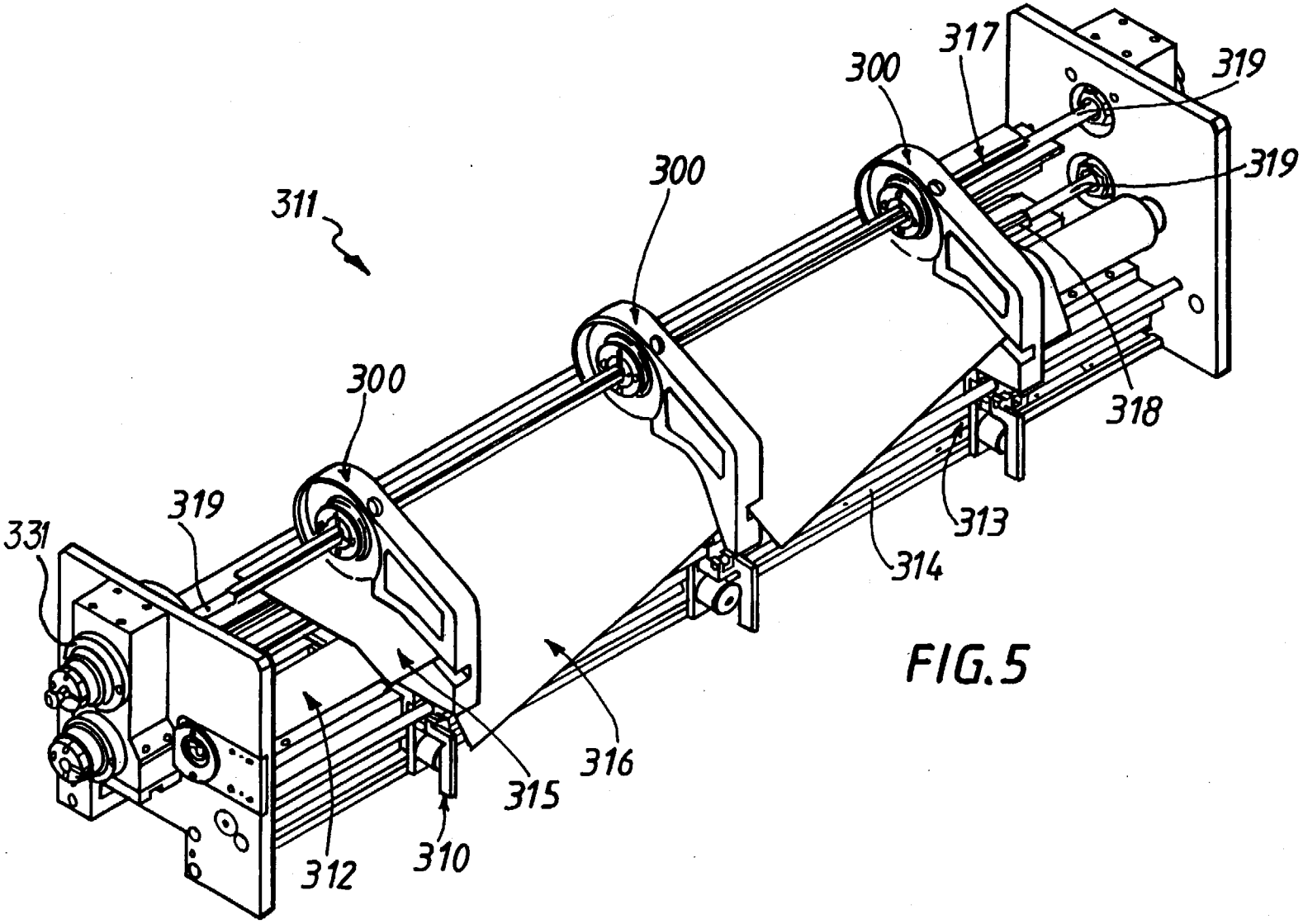
FIG. 5 depicts a cutting device on which there are mounted a plurality of cutting modules according to the present invention.

Reference is now made to FIGS. 2 and 5, which depict respectively a cutting module and a device equipped with three modules according to the invention.

The cutting module depicted in FIG. 2 comprises principally a frame 114, for example made of aluminum or steel, on which there are mounted rotatably a knife 101 and a bedknife 102. The knife and bedknife are mounted in such a way that their axes are substantially parallel to each other and so as to be brought very close together or to bear on each other over a part of their periphery in order to cut by shearing a web passing between them.

The knife and bedknife depicted are of the type having a hole formed substantially at their center in order to be mounted and driven on a cutting device which will be described in greater detail below. The latter characteristic is not, however, essential, in so far as, alternately, only the knife (or the bedknife) is driven by a drive shaft, the bedknife (or the knife) being driven by the movement of the first owing to the bearing force and the movement of the web between them. In reality, for some applications, the movement of the web passing between the knife and bedknife can be sufficient in itself to rotate both the knife and the bedknife. In the latter case, no drive shaft is needed.

The frame 114 has a guide raft 103 designed to cooperate with complementary guide means provided on a cutting device, in order to be mounted on the cutting device. The module is held in position on the device by means of a locking system comprising a split piece forming a bore 104 (designed to receive a rod provided on the cutting device (311, FIG. 5)) and whose diameter can, selectively, take a first value less than the diameter of the rod, so as to grip it tightly and immobilize the module on the device, and a second value, greater than the diameter of the rod, so as to allow the translational movement of the module on the rod and on the complementary guide means. Means (310, FIG. 5) are provided for moving from the first .diameter to the second and vice versa, that is to say in order, in alternation, to lock/unlock the module with respect to the cutting device. Advantageously, the module also includes a knurled knob 105 bearing a pinion (313, FIG. 5) at its end and designed to cooperate with a rack (314, FIG. 5) provided on the cutting device so as to facilitate the translational movement of the module. Alternatively, the modules are moved on the cutting shaft by means of a geared motor provided on each module, means such as, for example, a magnetic incremental role or an optical absolute rule for measuring the axial position of the modules on the shaft.

The frame 114 preferably has a passage 106 designed to receive one or two rollers (312, FIG. 5) so as to enable the cut webs to be guided. Thus the two webs produced by the knife/bedknife pass over the roller 312, on leaving which they are separated, one being guided on a first path (315, FIG. 5), the other on a second path (316, FIG. 5), distinct from the first.

Figure 3:
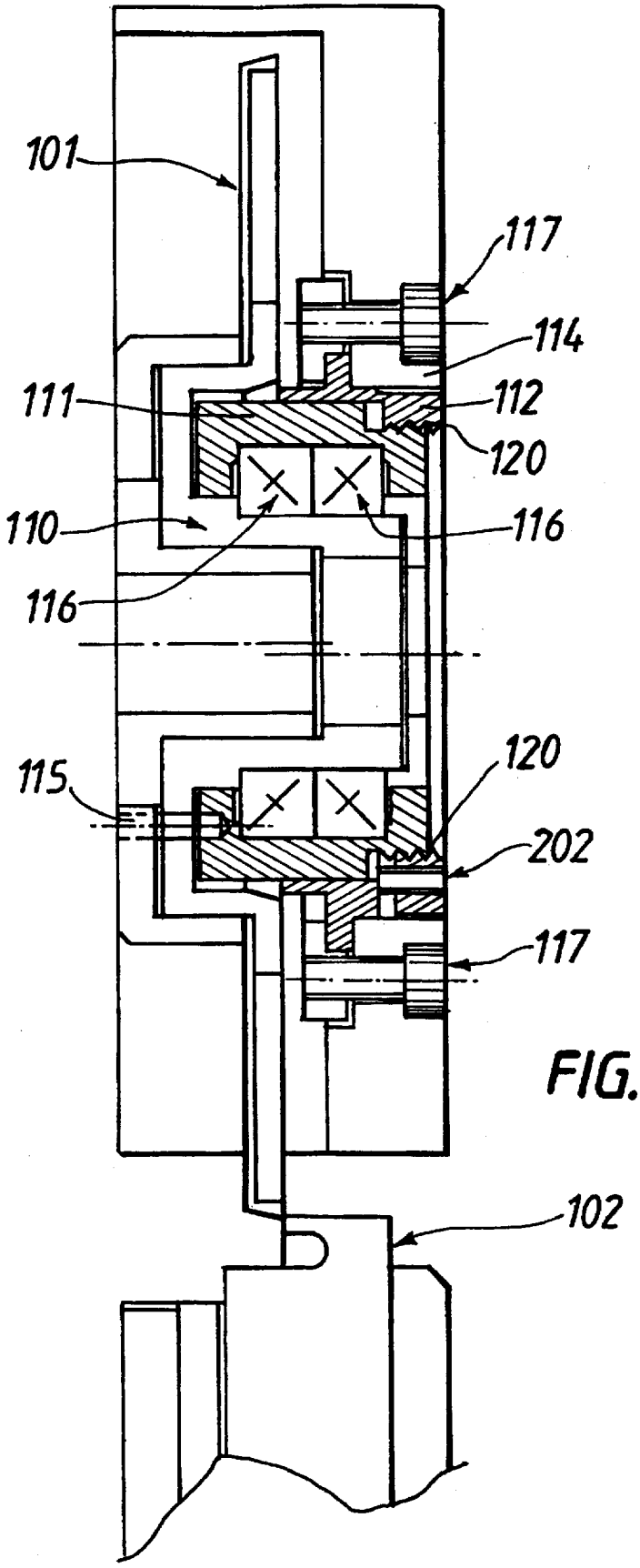
FIG. 3 depicts, in a detailed manner, the mechanism used to adjust the penetration and bearing of the cutting module according to the invention.

FIG. 3, to which reference is now made, illustrates diagrammatically an advantageous embodiment of the mechanism for adjusting the penetration and bearing. According to the embodiment depicted, the adjustment mechanism is provided on the knife. Alternatively, such a mechanism could be mounted on the bedknife.

As is clear in FIG. 3, the knife 101 is mounted fixedly on a knife carrier 110 rotatably mounted on an intermediate member 111 by means, for example, of roller bearings 116. The intermediate member is mounted, for example by screwing, on a ring 112 with an eccentric so that, by modifying the screwing of the ring 112 onto the intermediate member 111, the axial position of the knife with respect to the bedknife is modified, thereby modifying the bearing of one on the other.

Figure 4B:
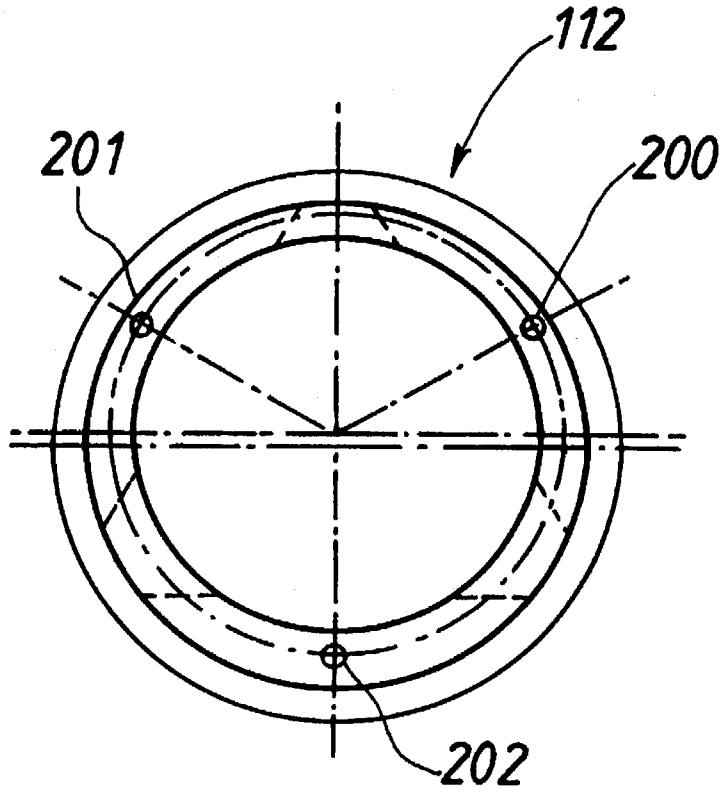
FIGS. 4A–4B illustrate diagrammatically a side elevation and a front elevation of the intermediate member and the eccentric ring used to adjust the penetration and bearing of the cutting module according to the invention.
Figure 4A:
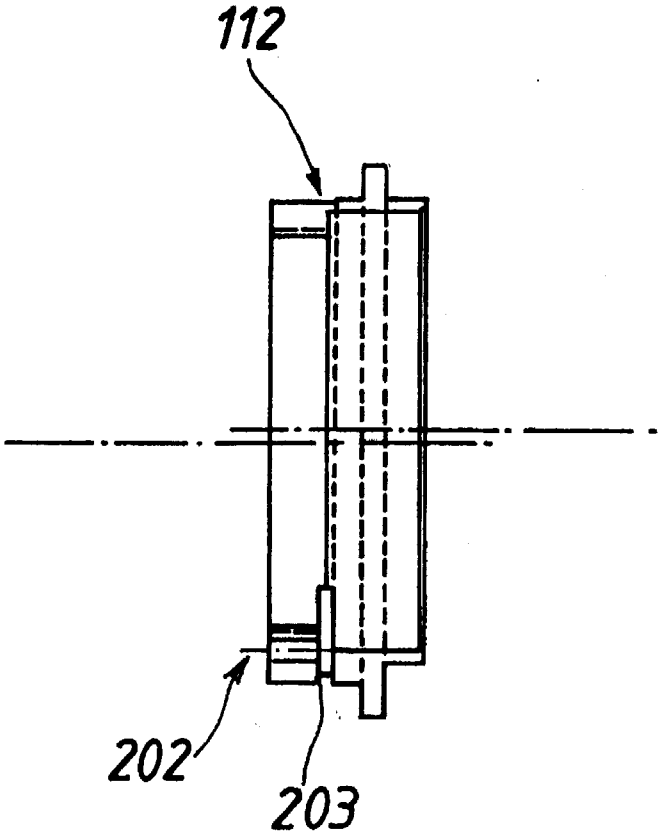

FIGS. 4A–4B, to which reference is now made, illustrate diagrammatically an embodiment of the eccentric ring according to the invention. As can be seen, the ring has three screws represented only by screw holes 200, 201, 202 and referred to by the same number, spaced out regularly over the periphery of the ring, and opening out on a split part 203 of the ring 112. Thus the screwing of the screws 200, 201, 202 produces a deformation in the ring, also deforming the thread 120 between the ring 112 and the intermediate member 111, thereby preventing any rotational movement of one with respect to the other. According to another advantageous characteristic of the invention, the eccentric ring has angular graduations so that the interaxial distance can be adjusted precisely, and this adjustment is done in an identical manner for all the modules of the cutting device.

As illustrated in FIG. 3, the module also comprises means 115 for temporarily immobilizing the knife 101 and knife carrier 110 with respect to the intermediate member 111. Such means comprise, for example, a first hole formed in the knife carrier and a second hole formed in the intermediate member, the immobilization being effected by aligning the first and second holes and inserting therein a pin 115 of appropriate length in order to fix together the knife carrier 110 and intermediate member 111.

Thus, in order to modify the bearing of the knife with respect to the bedknife, the knife 101 and knife carrier 110 are fixed to the intermediate member 111 by means of the pin 115; the screwing of the intermediate member onto the ring 112 is released by means of the screws 200, 201, 202. After the position of one 112 has been correctly adjusted with respect to the other 111, the screws 200, 201, 202 are again locked and the pin 115 withdrawn.

The ring 112 with an eccentric is also fixed to the frame 114 by means of the screws 117. Typically, the eccentric is around 1.5 mm and determines according to its angular position the distance between the axis of the knife 101 and the axis of the knife carrier 102. To this end, the knife 101, 110 is again fixed to the intermediate member 111; the screws 117 are released so as to free the ring 112 with an eccentric with respect to rotation. The assembly is turned through the angle needed in order to obtain the predetermined variation in interaxial distance; the ring is then re-immobilized by means of the screws 117; finally the pin 115 is withdrawn. The module is then ready once again for a cutting cycle.

Figure 1:
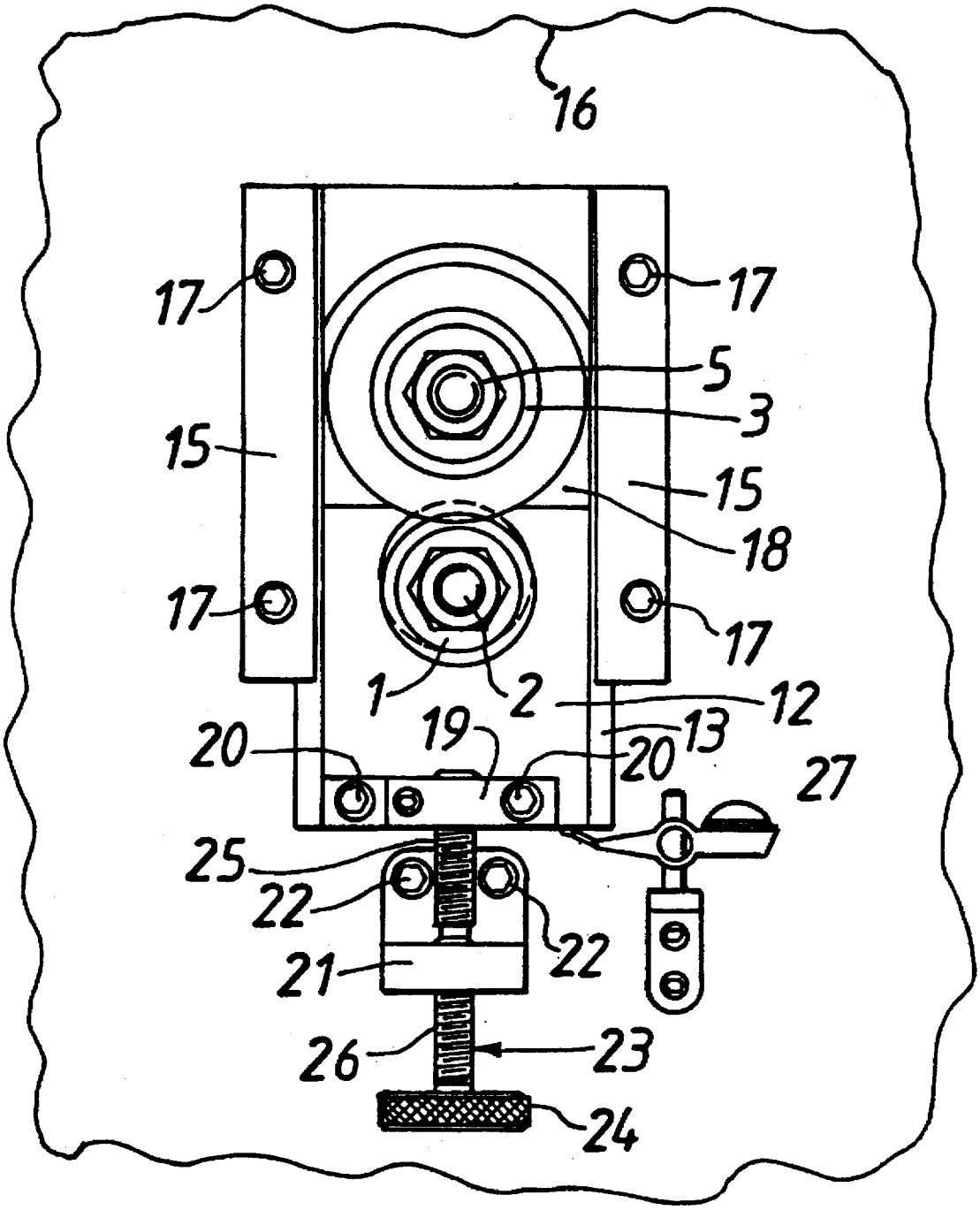
(PRIOR ART) FIG.1
FIG. 1 depicts a penetration adjustment device as described in the patent U.S. Pat. No. 3,055,249.

FIG. 5, to which reference is again made, depicts a cutting device on which there is mounted at least one cutting module 300 according to the present invention. The mounting of the knives on the device has already, in part, been described with reference to FIG. 1 and consequently will not be described in detail.

In the embodiment depicted, the knives and bedknives are mounted respectively on a first shaft 317 and on a second shaft 318, substantially parallel with each other, at least one of the shafts preferably being motorized. The shaft driving the knives (or the bedknives if the penetration and bearing adjustment mechanism is carried by the bedknives) is also mounted on an eccentric 33, substantially identical to that of the knives, and angularly positioned substantially identically to the eccentrics of each of the modules 300 of the cutting device. Also preferably, the shafts are non-circular in shape (substantially square, for example, with the edges more or less truncated), the said knives and bedknives being mounted on a support having a hole of corresponding shape in order to enable them to be driven by the corresponding shaft.

Advantageously, the shape of the shafts over at least a portion 319 of their length (preferably at one or other or both of their ends) is such that the knives and bedknives of the cutting modules positioned on such portions are not driven in rotation. In reality, it is sufficient for the shafts to have, on these portions, a shape which, in rotation, does not interfere with the shape of the bore of the knife or of its support, the circular shape being a preferred shape. This characteristic enables unused modules to be moved away without the need to remove them from the device. Preferably, the circular portions of the shaft carrying the knives and of the shaft carrying the bedknives are slightly offset axially so that the knives (or bedknives) are engaged shortly before the bedknives (or knives) are engaged, thereby facilitating the positioning of the modules on the "driving" part of the shafts. Also preferably, the shafts are designed so that the transition between the "driving" portions and the "non-driving" portions takes place progressively. In other words, it is desirable to avoid an abrupt transition between the circular portion and the square portion. "Disengaging" them also avoids any wear on the knives and bedknives which would be an inevitable result of their rotation off-load.

Also advantageously, the knives and/or bedknives of each module are driven by means of an offset motorized shaft to which they are connected by a pulley mechanism connected by a belt or by a gear mechanism, the advantage of the pulley mechanism stemming from the fact that the penetration can be adjusted independently for each module. Moreover, mounting by means of an offset shaft facilitates the mounting/removal of a module on the cutting device.

While the invention has been described with particular reference to a preferred embodiment, it will be understood by those skilled in the art the various changes can be made and equivalents may be substituted for elements of the preferred embodiment without departing from the scope of the invention. In addition, many modifications may be made to adapt a particular situation in material to a teaching of the invention without departing from the essential teachings of the present invention.

We claim:

1. Cutting module for slitting web products, comprising:

a circular knife element and a circular bedknife element, each presenting a specific radius and a periphery and being rotatively mounted on a frame in such a way that their respective axes are substantially parallel to one another, the distance between said axes being such that the respective periphery of the knife and bedknife cooperate with each other in order to slit a web passing between said elements;

an eccentric ring having a cylindrical external surface presenting a first axis rotatable in a corresponding opening of the frame and an internal cylindrical surface having a first diameter and presenting a second axis distant from the first axis and parallel to said first axis;

an intermediate member having an external cylindrical surface presenting said first diameter in order to cooperate with the internal surface of said eccentric ring and an internal cylindrical surface adapted to receive and immobilize roller bearings in order to permit rotation of one of said elements with respect to the frame;

said intermediate member and said eccentric ring being provided with cooperating thread in order to be screwed one on the other and first blocking means having a first position wherein said eccentric ring and said intermediate member are immobilized with respect to each other;

second blocking means for temporarily immobilizing said one circular element with respect to the intermediate member; and third blocking means having a first position wherein the eccentric ring is immobilized with respect to the frame and a second position wherein the eccentric ring could be rotated with respect to the frame in order to modify the distance between the axes of said circular knife and bedknife elements wherein the knife is mounted fixedly on a knife carrier rotatably mounted on said intermediate member.

2. A device for the longitudinal cutting of web products having a length and a transverse size, comprising at least one cutting module according to claim 1.

3. A device according to claim 2, wherein the circular knives and bedknives are each provided with a central hole centered on their respective axes, the device comprising two substantially parallel shafts, positioned so as to receive respectively the knives and bedknives in their respective holes and supporting means to support at least one cutting module, said modules having means cooperating with the supporting means provided on the device, and locking means enabling said at least one module to be immobilized on said supporting means so that it is possible to adjust the location of said module with respect to transverse size of the web product.

4. A device according to claim 3, wherein the shafts present a non-circular shape section, said knives and bedknives being mounted on an element having a hole of appropriate shape in order to enable them to be driven by the said shafts, at least one of the shafts being connected to a motor.

5. A device according to claim 4, wherein the shape section of the shafts over at least an end portion of their length is such that the knives and bedknives of the cutting modules positioned on such portions are not driven in rotation.

6. A device according to claim 5, wherein on the said end portions, the shafts present a circular shape section.

7. Cutting module according to claim 1, wherein said first blocking means consists of three screws, regularly angularly spaced over said eccentric ring, acting so as to lock the screwing between the ring and the intermediate member, thereby preventing any rotation of the ring with respect to said intermediate member.

8. Cutting module according to claim 1, wherein the adjustment of the distance between the axes of said circular knife said bedknife elements is obtained by a) temporarily immobilizing said one circular element with respect to the intermediate member;

b) enabling rotation of the eccentric ring with respect to the frame with said third blocking means;

c) immobilizing said intermediate member with respect to said eccentric ring and rotation said one circular element so as to cause said eccentric ring to turn through a given angle.

9. Cutting module according to claim 1, wherein said second blocking means comprises a first hole formed in the knife carrier and a second hole formed in the intermediate member, the immobilization being effected by aligning said first and second holes and inserting therein a pin of appropriate length.

10. Cutting module according to claim 1, wherein said third blocking means comprises at least one screw provided in the frame and which, in the first position, bears on the eccentric ring so as to immobilize it, the unlocking being effected by turning the screw so that the screw no longer bears on the ring.

* * * * *